United States Patent [19]

Haldemann

[11] 4,224,894

[45] Sep. 30, 1980

[54] DEVICE FOR INDICATING A SYMBOL REPRESENTING THE LOCATION OF A PARKING PLACE

[76] Inventor: Hugo Haldemann, Unt. Rebbergweg 132, 4153 Reinach, Kanton Basel, Switzerland

[21] Appl. No.: 46,718

[22] Filed: Jun. 8, 1979

[30] Foreign Application Priority Data

Jun. 26, 1978 [CH] Switzerland ..... 6945/78

[51] Int. Cl.[3] ..... G09F 11/04

[52] U.S. Cl. ..... 116/209; 40/495

[58] Field of Search ..... 116/209; 70/456; D3/60, D3/61; 40/2 A, 495

[56] References Cited

U.S. PATENT DOCUMENTS

| | | | |
|---|---|---|---|
| 2,284,903 | 6/1942 | Illmer | 40/495 |
| 2,537,598 | 1/1951 | Mason | 40/495 X |
| 2,596,374 | 5/1952 | Crapster | 40/2 A X |
| 3,553,867 | 1/1971 | Von Behren | 40/495 |
| 3,604,134 | 9/1971 | Clark | 40/495 |
| 3,852,900 | 12/1974 | Svec | 40/495 |

FOREIGN PATENT DOCUMENTS

| | | | |
|---|---|---|---|
| 6801157 | 3/1969 | Fed. Rep. of Germany | 40/495 |
| 7402421 | 4/1974 | Fed. Rep. of Germany | 40/495 |
| 7527748 | 12/1975 | Fed. Rep. of Germany | 40/495 |
| 7611236 | 4/1976 | Fed. Rep. of Germany | 40/495 |

*Primary Examiner*—Daniel M. Yasich

*Attorney, Agent, or Firm*—Wigman & Cohen

[57] ABSTRACT

The device comprises a casing in the form of a circular ring having two conically converging outer surfaces provided with symbols and two identical circular discs inserted in the casing and provided each with an arrow. The discs which lie in parallel planes are held together by a bolt and are rotatable in the casing independently of each other in both directions. On the inner side of the casing there are provided recesses, the number of which corresponds to the number of the symbols. In each disc there are provided locking means, which reenter in one of the recesses for locking the disc during its rotational movement.

7 Claims, 3 Drawing Figures

DEVICE FOR INDICATING A SYMBOL REPRESENTING THE LOCATION OF A PARKING PLACE

BACKGROUND OF THE INVENTION

This invention relates to a device for indicating a symbol representing the location of a parking place in which a car has been parked, said device being detachably connected to an ignition key of the parked car and comprising a casing in the form of a circular ring having two conically converging outer surfaces provided with symbols, and further comprising two identical circular discs, each of them provided with an arrow, said circular discs being accomodated in said casing in parallel planes, being rotatable in said casing independently of each other in both directions, and being held together by a bolt running through their centers.

When a car has been parked in a large parking house having several levels or on a parking lot divided into sectors and numbered individual parking places, the finding of the parked car is connected with certain difficulties or at least with a loss of time.

SUMMARY OF THE INVENTION

It is an object of the invention to provide a device for indicating a symbol representing the location of a parking place which is detachably connected to an ignition key by means of which device these difficulties can be overcome. Besides, such a device should comprise only few parts so that its production costs are low. The manipulation of such a device should be quite simple.

These objects are achieved by a device for indicating a symbol representing the location of a parking place as mentioned above, characterized by recesses provided on the inner side of the casing, the number of which recesses corresponds to the number of the symbols, said recesses extending radially outwards to coincide with respective symbols, and by locking means provided in each disc for locking said disc in one of said recesses during rotation of said disc.

The locking means comprises a bore provided in each of the discs, said bore running radially and opening on the circumference of the disc, in which bore a compression spring and a peg are accomodated, said peg abutting against said compression spring, partially jutting out of said bore, and being biased by said compression spring to re-enter one of the recesses after said peg has run over a projection between two neighbouring recesses during the rotation of said disc.

BRIEF DESCRIPTION OF THE DRAWINGS

A preferred embodiment of the invention is shown in the accompanying drawing.

DETAILED DESCRIPTION OF THE PREFERRED EMBODIMENT

Figure 1:
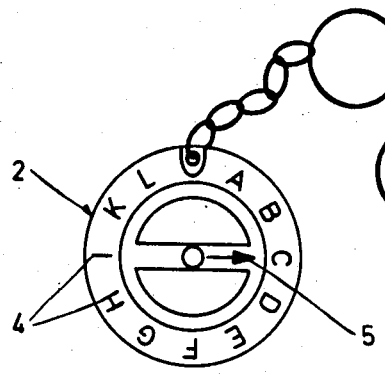
FIG. 1 is an elevation of the inventive device seen from one side.
Figure 2:
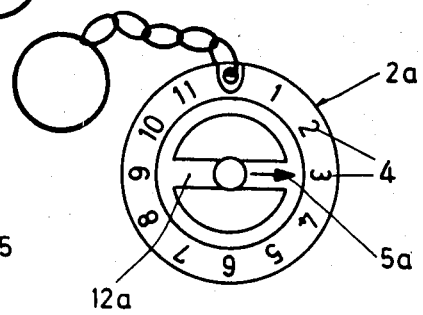
FIG. 2 is an elevation of the inventive device seen from the other side.
Figure 3:
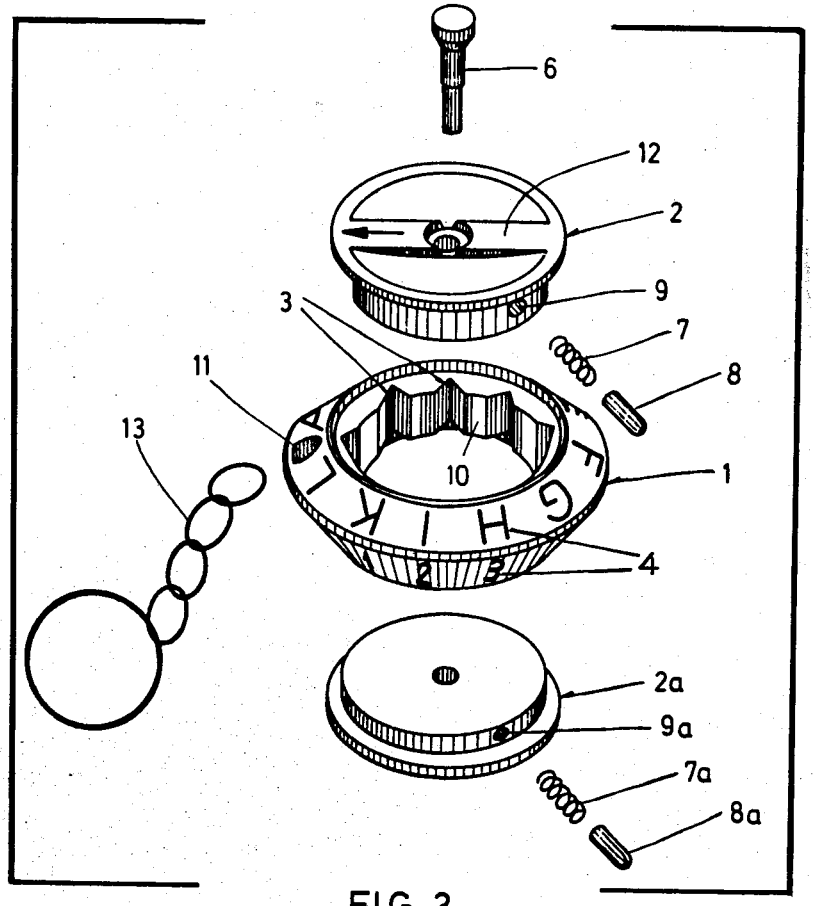
FIG. 3 is an exploded view of the inventive device.

The device for indicating a symbol representing the location of a parking place on which a car has been parked according to FIGS. 1 and 2 is detachably connected to an ignition key of the parked car by means of a chain 13. As it can be seen from FIG. 3, the device comprises a casing 1 in the form of a circular ring, the two outer surfaces of which conically converge together; they are provided with symbols 4. These symbols which consist of letters and arabic numerals in the shown embodiment can be also replaced by colours and other symbols. In the outer sides of the casing 1 there is a bore 11 serving for the chain 13 to be tied on therein. On the inner side of the casing 1 there is a number of recesses 3 which correspond with the number of the symbols 4. The recesses 3 coincide in their radial prolongation with the symbols 4 on both the outer sides of the casing 1. Between two neighbouring recesses 3 respectively there is provided a projection 10.

The inner wall of the casing 1 is formed on its outer surface in such a way that it provides an edge receiving a disc 2, 2*a* respectively. Both the discs are circular in their shape and identical to each other. A bolt 6 runs through their centers by means of which bolt the discs 2, 2*a* are held together. Each disc is provided with a rib 12, 12*a* on its outer side which protrudes from the partially sunk outer surface of each disc. The rib 12 will be held by the thumb and a finger during the rotational movement of the disc.

On the rid 12, 12*a* there is applied an arrow 5, 5*a* which points toward the circumference of the disc 2, 2*a*.

Each disc 2, 2*a* has a radial bore 9, 9*a* opening on the circumference of the disc in which a compression spring 7, 7*a* and a peg 8, 8*a* are provided; the peg abuts against the spring 7, 7*a* and partially juts out of the bore 7, 7*a;* the spring as well as the peg 8, 8*a* are loosely introduced in the bore 9, 9*a*. During the rotational movement of the disc 2, 2*a* the peg 8, 8*a* runs over the projections 10 on the inner side of the casing 1 whereby the peg 8, 8*a* will be partially pressed into the bore 9, 9*a* against the action of the spring 7, 7*a*. After the peg 8, 8*a* has run over the projection 10 it re-enters into one recess 3 biased by the spring. In order to determine the required symbol in one of the outer sides of the casing 1, one of the discs 2, 2*a* will be rotated so long as the peg 8, 8*a* re-enters into the recess 3 lying in the proximity of the required symbol, whereafter the arrow 5, 5*a* points toward the desired symbol 4.

The same procedure takes place when the other disc lying opposite to the first disc is rotated. The discs 2, 2*a* can be rotated in parallel planes in both directions independently of each other in order to fix both the rows of the symbols.

In order to reduce the weight of the device to its minimum, the casing 1 and both the discs 2, 2*a* are made of plastic.

When the owner of the car has parked his car in a parking house or on a parking lot, he rotates the discs of the described device detachably connected to his ignition key to indicate those symbols representing the loction of the parking-place on which the car has been parked. With the above described embodiment of the device the one disc will be rotated to indicate the respective numeral and the other one to indicate the respective letter. When the owner wants to find his car, he has to take a glimpse at the device indicating the identity of the parking place which will enable him to remember the location of the parking place and to find his car parked thereon without difficulty. The described device is a simple and a low-priced means which is advantageous for each car driver.

What is claimed is:

1. A device having a symbol representing the location of a parking place on which a car has been parked, comprising:

a casing in the form of a circular ring having two conically converging outer surfaces provided with symbols, two identical circular discs being accommodated in said casing in parallel planes and being rotatable in said casing independently of each other in both directions, recess means being provided on the inner side of the casing, the number of which recess means corresponds to the number of the symbols, said recess means extending radially outwards to coincide with respective symbols, and locking means, provided in each disc, for locking said disc in one of said recess means during rotation of said disc.

2. The device according to claim 1, wherein said locking means comprises:

a bore means provided in each of the discs, said bore means running radially and opening on the circumference of the disc, and a compression spring and a peg being accommodated in said bore means, said peg abutting against said compression spring, partially jutting out of said bore means, and being biased by said compression spring to re-enter one of the recess means after said peg has run over a projection between two neighboring recess means during the rotation of said disc which provides said bore means in which said compression spring and said peg are accommodated.

3. The device according to claim 1, wherein the casing and the discs are made of plastic.

4. The device according to claim 1, wherein the device is detachably connected by a chain means to an ignition key of the car that has been parked.

5. The device according to claim 1, wherein said circular discs are each provided with an arrow means for pointing to any one of the number of symbols.

6. The device according to claim 1, wherein said circular discs are held together by a bolt running through their centers.

7. A device for aiding in the location of a parking place on which a car has been parked, comprising:

a casing in the form of a circular ring having a central opening and two conically converging outer surfaces marked with symbols, two identical circular discs lying opposite to each other, said circular discs being accommodated in said casing in parallel planes and being rotatable independently of each other in both directions, wherein the inner wall of said casing defines said central opening and is provided with recesses, the number of which recesses corresponds to the number of the symbols, said recesses—when extended radially outwardly—coincide with respective symbols, and wherein said disc has a bore running radially and opening on the circumference of the disc, in which bore a compression spring a peg are accommodated, said peg abutting against said compression spring and partially jutting out of said bore, and being biased by said compression spring to re-enter one of the recesses after said peg has run over a projection between two neighboring recesses during the rotation of said disc which has the bore that accommodates said compression spring and said peg.

* * * * *

UNITED STATES PATENT AND TRADEMARK OFFICE

CERTIFICATE OF CORRECTION

PATENT NO. : 4,224,894

DATED : September 30, 1980

INVENTOR(S) : Hugo Haldemann

It is certified that error appears in the above-identified patent and that said Letters Patent are hereby corrected as shown below:

Column 1, line 42, change "comprises" to --comprise--.

Claim 7, line 25, change "said" to --each--;

line 27, after "spring" insert --and--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*